United States Patent [19]

Warnke

[11] Patent Number: 4,503,559

[45] Date of Patent: Mar. 5, 1985

[54] POPCORN BAG

[76] Inventor: Patsy L. Warnke, 700 W. Ridgeway, No. 420, Waterloo, Iowa 50701

[21] Appl. No.: 419,434

[22] Filed: Sep. 20, 1982

[51] Int. Cl.[3] ..... B07B 13/04; B65D 30/02

[52] U.S. Cl. ..... 383/40; 209/680; 383/41; 383/117

[58] Field of Search ..... 383/40, 41, 117, 102, 383/103, 109, 906; 209/606, 680, 235, 315, 397; 99/323; 150/37

[56] References Cited

U.S. PATENT DOCUMENTS

| | | | |
|---|---|---|---|
| 468,102 | 2/1892 | Staley | 99/323 |
| 1,141,727 | 6/1915 | Seaman | 209/680 X |
| 1,251,404 | 12/1917 | Mills | 383/40 X |
| 1,516,782 | 11/1924 | Oberschmidt | 99/323 |
| 1,662,738 | 3/1928 | Coogle | 383/117 X |
| 1,895,744 | 1/1933 | Arnold | 383/40 X |
| 1,965,040 | 7/1934 | Kelly | 383/40 X |
| 2,015,119 | 9/1935 | McEwen | 383/40 |
| 2,349,672 | 5/1944 | Nielsen | 383/117 X |
| 4,156,446 | 5/1979 | Nathan | 383/40 X |

*Primary Examiner*—William Price
*Assistant Examiner*—Gary E. Elkins
*Attorney, Agent, or Firm*—James C. Nemmers

[57] ABSTRACT

A bag facilitating the separation of popcorn from unpopped kernels and providing a convenient bag for holding the popped corn while a person eats it. The bag has an outer bag of fine mesh and an inner bag of coarser mesh through which unpopped corn can pass thereby separating it from the popped corn.

3 Claims, 2 Drawing Figures

POPCORN BAG

BACKGROUND OF THE INVENTION

Popcorn is one of the favorite snack foods of the American people. This is because it is inexpensive, easy to prepare and contains relatively few calories. It is also a reasonably healthy food and quite tasty.

In recent years numerous electric popcorn poppers have been marketed some of which use the principle of heated air rather than heating the corn in a pan-like popper containing edible oil. Popcorn poppers have also been designed for use in microwave ovens. All of these poppers provide a convenient and fast method of popping corn, but no popcorn popper has ever been designed which will completely pop each and every kernel. Some popcorn poppers leave a relatively high percentage of unpopped kernels. Most people who enjoy a popcorn snack do not care to eat the unpopped kernels since they are quite hard. Also, popcorn is sometimes mixed with a syrup-like substance and formed into popcorn balls. When popcorn balls are made, it is highly desirable not to have any unpopped kernels which can, on occasion, chip a tooth of an unsuspecting eater.

The unpopped kernels can, of course, be separated from the popped corn by placing it in a large pan, box or other container and then shaking the container. Normally, most of the unpopped kernels will fall to the bottom of the container and the popped corn can be poured off the top leaving most of the unpopped kernels in the bottom of the container. This is not completely satisfactory since it does require a rather large container, and when the popped corn is poured off, frequently a few unpopped kernels find their way back into the popped corn.

There is therefore a need for an easy and inexpensive way of quickly separating popped corn from the unpopped kernels. Such an article should also be attractive, easy to store and easy to clean.

SUMMARY OF THE INVENTION

The invention consists of a flexible lightweight container that has an inner bag and an outer bag. Both the inner and outer bags are made of a mesh material, but the outer bag is of a sufficiently fine mesh to prevent unpopped kernels from passing through it. The inner bag is of a coarse mesh which will permit unpopped kernels to pass through it but which will prevent popped corn from passing through. Preferably, the inner bag is slightly smaller than the outer bag leaving an area at the bottom of the outer bag beneath the inner bag. Both bags are preferably joined at the top and can be provided with a drawstring or other means for closing. Also, the small compartment formed at the bottom of the outer bag beneath the inner bag can be provided with a closable opening to permit the unpopped kernels to be emptied.

DESCRIPTION OF THE PREFERRED EMBODIMENT OF THE INVENTION

Figure 1:
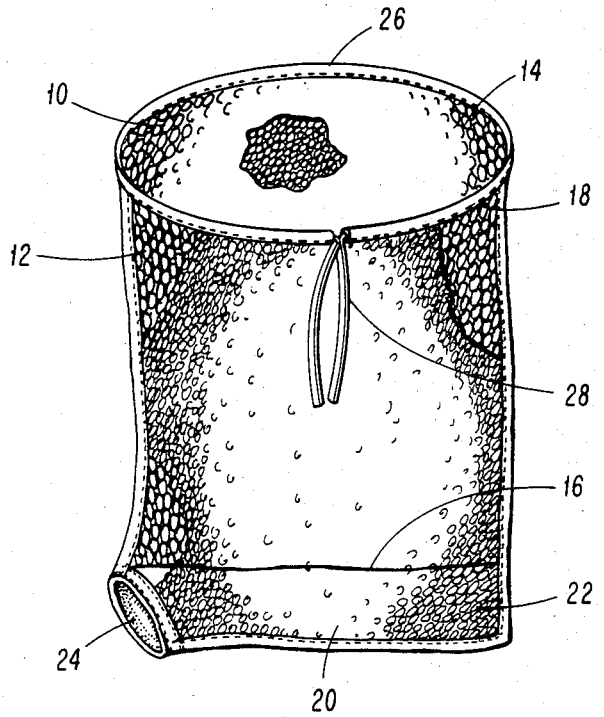
FIG. 1 is a perspective view of a popcorn bag constructed according to the principles of the invention.
Figure 2:
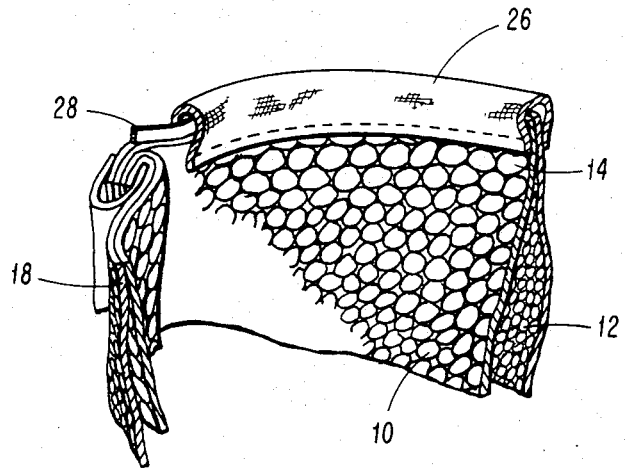
FIG. 2 is a partial sectional view of the side and top seams of the bag.

Referring to the drawing, the popcorn bag of the invention is quite simple and has an inner bag 10 and an outer bag 12. The inner bag 10 is open at its top 14 and closed at its bottom 16. The sides of the inner bag 10 are also closed. The inner bag 10 is formed of any suitable lightweight flexible material. Preferably, the inner bag can be of a nylon or plastic mesh material the openings of which are large enough to permit the passage of an unpopped kernel of corn but small enough to prevent the passage of popped corn. The inner bag 10 of course could be of a solid material formed with a plurality of openings near the bottom 16.

The outer bag 12 is also formed of any suitable lightweight flexible material. The outer bag could be formed of a solid piece of material, but preferably it is formed of a fine mesh material in which the openings are too small to prevent the passage of even the unpopped kernels. The mesh material provides a "see-through" appearance so that the user can readily see if the unpopped kernels are being separated from the popped corn in the manner described hereinafter.

The outer bag is also open at its top 18 and closed at its bottom 20. The outer bag 12 is of course closed along its sides. Preferably, when the inner and outer bag are assembled, the sides of both the inner bag 10 and outer bag 12 can be sewn together to enclose them. This will also keep the two bags from becoming separated when the bag is used.

The outer bag 12 is larger from its top 18 to its bottom 20 than is the inner bag from its top 14 to its bottom 16. This difference in dimension forms a compartment 22 between the bottom 16 of the inner bag 10 and bottom 20 of the outer bag 12. If desired, a closable opening 24 can be formed at one side of the compartment 22. This closable opening can be made by use of a zipper, snaps, Velcro or any other suitable fastener.

Also, the top 14 of the inner bag 10 may be joined to the top 18 of the outer bag 12 by also sewing them together with a reinforcing strip of material 26 through which a drawstring 28 extends to permit the bag to be closed if desired. Reinforcing material may also be provided along the sides and bottom of the outer bag 12 if desired. When the bag is assembled with the inner bag 10 and outer bag 12 sewn or otherwise joined together as described above, it gives the appearance of a single bag with a drawstring 28 at the top and a closable opening 24 at one corner of the bottom.

The use of the bag depends upon the type of the popcorn popper used. With hot air poppers, the top of the bag can be placed over the spout of the popper and tied around the spout using the drawstring 28. As the corn pops and is expelled through the spout of the popper, it will fill the bag. With other poppers which do not have a discharge spout, the popcorn is made in the usual manner and then poured into the open top of the bag. After the corn has been placed in the bag, the bag is shaken until all of the unpopped kernels pass through the inner bag 10 into the compartment 22. If the outer bag is made with a fine mesh material, the user can observe whether all of the unpopped kernels have been separated from the popped corn which will, of course, remain in the inner bag 10. The unpopped kernels can then be easily poured out through the closable opening 24 and the popcorn eaten directly from the bag without fear of biting on an unpopped kernel or the popped kernels can be poured out into another container or containers.

If the bag of the invention is constructed of durable washable materials, it will have a long life and can be washed as frequently as desired and easily drip dried. The bag provides a convenient quick, easy and inexpensive way of separating the unpopped kernels from the popped corn thus increasing the enjoyment of popcorn lovers.

Having thus described the invention in connection with the preferred embodiment thereof, it will be obvious to those skilled in the art that various revisions and modifications can be made to the preferred embodiment disclosed herein without departing from the spirit and scope of the invention. It is my intention, however, that all such revisions and modifications as are obvious to those skilled in the art will be included within the scope of the following claims.

What is claimed is:

1. A flexible lightweight container for separating popped corn from unpopped kernels of corn, said container comprising an inner bag and an outer bag each open and joined at the top, the inner bag being formed of a mesh material in which the openings are large enough to allow unpopped kernels of corn to pass through them but small enough to prevent popped corn from passing through them, the outer bag being formed of a mesh material the openings of which are small enough to prevent both popped corn and unpopped kernels of corn from passing through them, and the inner bag being smaller than the outer bag to form a space between the bottom of the inner bag and the bottom of the outer bag, the space thereby receiving unpopped kernels that pass through the openings in the inner bag.

2. The flexible lightweight container of claim 1 including means for closing the joined tops of the inner bag and outer bag.

3. The flexible lightweight container of claim 2 in which the space formed between the bottom of the inner bag and the bottom of the outer bag has a closeable opening that facilitates the removal of the unpopped kernals of corn from that space.

* * * * *